US006299501B1

(12) United States Patent
Lynch

(10) Patent No.: US 6,299,501 B1
(45) Date of Patent: Oct. 9, 2001

(54) APPARATUS FOR SATISFYING THE NON-NUTRITIVE, ORAL-MOTOR SUCKING NEEDS OF INFANTS

(76) Inventor: Therese Anthony Lynch, 7217 Willow Ave., Takoma Park, MD (US) 20912

( * ) Notice: Subject to any disclaimer, the term of this patent is extended or adjusted under 35 U.S.C. 154(b) by 0 days.

(21) Appl. No.: 09/436,643

(22) Filed: Nov. 9, 1999

(51) Int. Cl.[7] ..... A63H 3/00

(52) U.S. Cl. ..... 446/73; 606/234; 446/227; 446/385

(58) Field of Search ..... 606/234–236; 446/81, 419, 491

(56) References Cited

U.S. PATENT DOCUMENTS 4,277,910 * 7/1981 Kramer ..... 606/234
5,534,014 * 7/1996 Demeritt et al. ..... 606/234
5,593,336 * 1/1997 Thomas ..... 446/81
5,665,113 * 9/1997 Decker et al. ..... 606/234
5,908,439 * 6/1999 Ford et al. ..... 606/234

* cited by examiner

*Primary Examiner*—Angela D. Sykes
*Assistant Examiner*—Kristen Droesch
(74) *Attorney, Agent, or Firm*—Thomas E. Lynch

(57) ABSTRACT

An apparatus for satisfying the non-nutritive sucking needs of infants, especially medically compromised infants, which includes an infant's pacifier holder near one end of a wand-like structure; wherein the pacifier holder comprises a two-piece tab-flap fastener for holding the pacifier to the wand; wherein the wand-like structure is formed on a non-toxic, non-allergenic, elastomeric material which is easily cleaned and will not harbor infectious germs or viruses, and wherein the wand-like structure can take the form of an adorable toy animal such as an otter.

14 Claims, 3 Drawing Sheets

APPARATUS FOR SATISFYING THE NON-NUTRITIVE, ORAL-MOTOR SUCKING NEEDS OF INFANTS

BACKGROUND OF THE INVENTION

1. Field of Invention

The present invention pertains to a unique, wand-type holder or tool for securely supporting an infant's pacifier in use, while at the same time providing an easy to grasp extension wand as part of the holder for enabling the infant to reinforce his/her grasping skills. My pacifier holder further provides a consistent perioral stimulation, and enhances the infant's ability to control and keep the pacifier in his/her mouth for independent sucking. More particularly, my unique invention holds the pacifier near one end of the wand, and enables the infant to grasp, manipulate, and cuddle the wand along its extended length. Thus, my invention permits the infant to safely hold and manipulate the pacifier within his/her mouth by grasping and manipulating the extension wand. Moreover, by grasping and manipulating the extension wand, the infant is able to reinsert the pacifier should it fall from his/her mouth. Therefore, my invention facilitates the infant's non-nutritive sucking skills, while at the same time exercising and enhancing the infant's grasping skills. Accordingly, my invention also satisfies the infant's need for physiologic stability.

As compared with the prior art, my invention performs all of these functions with a safe, hygienic, simple, low cost, and one-piece construction.

My invention is also unique because it enhances the non-nutritive sucking of medically compromised infants who often experience oral-motor difficulties. Because conventional pacifiers easily fall from such an infant's mouth, and are difficult or impossible to retrieve by the infant, their use by medically compromised infants is often difficult. Thus, conventional pacifiers increase the medically compromised infant's frustration, rather than satisfying his/her physiological needs which is supposed to be the function of a pacifier.

My invention is further novel because it also benefits healthy infants and young children, even after the need for a pacifier is no longer required. This is so because it has the shape of an adorable and engaging animal toy, along with its ability to securely hold the pacifier. Moreover, after the infant has matured to the point where the need for a pacifier has passed, my unique overlapping tab-flap holder for the pacifier becomes the loosely flapping arms or flippers for the animal toy.

The unique overlapping tab-flap pacifier holder also functions to hold a variety of different sizes and shapes of pacifiers. Therefore, my invention is not limited to a single type of pacifier as is the prior art. Moreover, my invention facilitates the easy interchanging of pacifiers, so that a fresh and hygienically clean pacifier can always be made available to the infant. This is especially important in a hospital environment where infection control and safety are of utmost importance.

The overlapping tab-flap construction of my invention securely holds the pacifier near one end of the extended wand so that neither the pacifier nor the tab-flap construction itself can be easily worked loose by the infant in use. Thus, my holder replaces the crude, jerry built prior art pacifier holders which usually rely on medical or Scotch® tape to hold the pacifier to the holder. The use of tape to hold the pacifier in place is not only crude, it is also unsanitary and it can easily pull loose to represent a choking hazard. My device, on the other hand, is not only effective, it is hygienic and will not easily pull apart to form a choking hazard.

Further, my invention is of a simple one-piece construction so that its cost of manufacture is greatly reduced as compared with other commercial, multi-piece versions of the prior art.

My invention is manufactured from a non-allergenic, non-toxic, elastomeric material which has a soft texture, and it is flexible, long-wearing, scuff resistant, heat resistant and inexpensive. As such, my invention is also easily cleaned and sanitized by any number of techniques. For example, my invention can be sterilized in boiling water, it can be manually washed with conventional soap and water, or it can be washed with any kitchen or laundry detergent. Moreover, my invention can also be easily cleaned automatically in a dishwasher. Alternatively, my invention can be cleaned in a laundry washing machine. Therefore, my invention can be cleaned and sanitized either with the dishes or with the laundry. Finally, my invention can also be cleaned and sterilized in many of the sterilizing machines typically used in hospital environments.

2. Discussion of the Background of the Invention

For many years the use of pacifiers has been commonplace to soothe restless infants, and to satisfy their non-nutritive sucking needs. Pacifiers take several general shapes and constructions. Thus, commercial pacifiers may include different sizes and shapes for the nipple, they may have a multi-part construction, they may be of one-piece construction, they may come with or without a handle, or they may have several different types of handles.

Whether or not to use a pacifier has been at times a problem for caregivers. For example, over the years pacifiers were sometimes frowned upon by the medical and dental professions who thought that they may be harmful to the developing infant. In fact, some medical professionals who are strong advocates of breast feeding, consider pacifiers to be an "abomination." See, Reisser et al. (Reisser), "*COMPLETE BOOK OF BABY @ CHILD CARE,*" Tyndale House Publishers, Inc., Wheaton, Ill., 1997, page 138. Another baby book states: "Some doctors think that constant use of a pacifier can affect a child's ability to make sounds and talk." "Many doctors recommend orthodontic-type pacifiers to minimize possible tooth-alignment problems in the future." See, "*AMERICAN MEDICAL ASSOCIATION COMPLETE GUIDE TO YOUR CHILDREN'S HEALTH*," Traisman et al. (Traisman), Random House, New York, N.Y., 1992, pages 40–41. Other doctors maintain that putting a baby to bed with a pacifier should be minimized. They assert: "A pacifier may interfere with your child's ability to develop his or her own self-comforting techniques and the child could wake up when the pacifier falls out of his or her mouth." See, Traisman, supra, page 57.

These professionals apparently assume that only nutritive sucking is healthy for the proper perioral and physiological development of infants. Thus, they assert that non-nutritive sucking devices are not only unnecessary, but may even cause problems for the developing infant. However, most of the medical profession, parents and caregivers have now found pacifiers to be invaluable in practice. This is because the non-nutritive sucking needs of an infant have proven to be very important to the developing infant who needs the consistent perioral stimulation and the physiological satisfaction that is provided by pacifiers. Therefore, pacifiers have proven to be very beneficial in the proper oral development of the infant. Accordingly, the use of pacifiers has expanded in the past several years.

Despite their benefits, for very young infants or medically compromised infants, pacifiers are often difficult to use in practice because, as noted by Traisman, supra, page 57, they may fall out of the very young or medically compromised infant's mouth and are not easily retrieved by the infant. This is because the grasping skills of such infants have not advanced fully. Thus, for example, when such an infant yawns or doses off, the pacifier may fall out of his/her mouth. Once the pacifier falls out of the infant's mouth, he/she may awaken with a start and become frustrated and fussy until the pacifier is reinserted by the parent or caregiver. Since the time of parents and caregivers may be limited, the constant reinserting of the pacifier into the infant's mouth has proven to be a difficult problem. Thus, over the years, there have been several proposed solutions to this problem. Many of these proposed solutions seem unworkable, but some worthwhile solutions have also been proposed.

For example, to simply attach the pacifier with a tether fastened to the infant's garment or around his/her neck is an impractical solution for very young or medically compromised infants because, even though the fallen pacifier may remain nearby, these infant's grasping skills are such that he/she is incapable of finding the pacifier, much less reinserting it into his/her mouth. More importantly, the use of pacifiers tethers around the infant's neck is frowned upon as a possible strangling threat to the child. See, Reisser, supra, page 138. An example of a tether for attaching a pacifier to the infant's garment is shown in the U.S. Patent to Huber et al. (Huber), U.S. Pat. No. 4,903,698, which issued on Feb. 27, 1990.

Other proposed solutions include holding the pacifier in the infant's mouth by tying it into his/her mouth with a strap which snugly fits around the head of the infant. An example of such a pacifier holder is found in the U.S. Patent to Beck, Jr. et al. (Beck), U.S. Pat. No. 2,834,350, which issued on May 13, 1958.

Another variation of the strap solution includes stretching elastic straps around each ear of the infant to securely hold the pacifier in his/her mouth. For example, see the U.S. Patent to Hempstead-Harris, U.S. Pat. No. 4,069,894, which issued on Nov. 13, 1990.

Such strap-like solutions appear impratical. Thus, for example, if the infant no longer wants the pacifier, he/she cannot just let it fall out of the mouth. The strap prevents this from happening.

In Neonatal Intensive Care Units (NICU) and Pediatric Intensive Care Units (PICU), a partial solution to this problem has been found by jerry building by hand pacifier holders from rolled towels and tape. Such a partial solution is depicted in Prior Art FIGS. 1(A–B) and FIG. 2. In these Figures, the thickness or thinness of the various components, such as the tape holding everything together, may be exaggerated to facilitate their disclosure.

Prior Art FIG. 1(A) is a top view of such a hand made device. Prior Art FIG. 1(B) is an orthogonal side view of such a hand made device wherein the pacifier (4) is shown extending to the right. Prior Art FIG. 2 is an orthogonal front view of such a hand made device wherein the pacifier (4) is shown extending from the top front of the device. This partial solution consists of tightly rolling and taping (via tape 6) a towel (7) to form a wand (1). A tightly rolled cloth diaper might be used as an alternative to the towel (7). Near one end of the tightly rolled towel (7), a pacifier (4) without a handle is attached with either Scotch® tape or medical tape (2-3) to hold the annular flange (5) of the pacifier (4) in place. Despite being hand made, such holders for pacifiers have been well-received by medical staffs and therapists. Unfortunately, however, these pacifier holders also quickly become dirty and result in a great risk for infection. Further, the tape (2-3) holding the pacifier to the rolled towel of this type of device can pull loose and present a choking hazard for the infant. Moreover, if the pacifier is not taped near the top end of the wand, the top edge of the rolled towel may interfere with the breathing of the infant through his/her nose. Of course, when taped near the end of the rolled towel, the tape (2-3) is more easily pulled loose to cause the choking hazard. Accordingly, such potential dangers have prevented the widespread use of such hand made pacifier holders of this type.

There have been other commercial devices which perform in a manner comparable to the hand made devices of Prior Art FIGS. 1(A–B) and 2. For example, the U.S. Patent to Ford et al. (Ford), U.S. Pat. No. 5,908,439, issued Jun. 1, 1999, discloses a semi-flexible tube or wand (108) which the infant can grasp. The tube (108) can be hollow and formed of urethane or semi-rigid foam (col. 2, lines 61–65). Alternatively, the tube (108) can be a rolled up diaper (col. 3, lines 41–44). A pacifier (106) is attached at one end of the wand by means of a cloth (100). The pacifier (106) is held at one end of the tube (108) when the cloth (100) is fully wrapped around the tube. A hole (102) is provided at one upper end of the cloth (100), whereby the nipple of the pacifier (106) is allowed to pass through the cloth (100).

To attach Ford's pacifier to the tube requires several manipulative steps: First, the pacifier (106) must be held at one end of the tube. Secondly, the nipple of the pacifier is passed through the hole (102) in the cloth (100). Finally, the cloth (100) is rolled around the tube until the VELCRO® fasteners (104) mate, thereby holding the whole unit together. Once assembled and in use, the Ford device is quite similar to the hand made devices of Prior Art FIGS. 1(A–B) and FIG. 2. Thus, Ford's device can becomes dirty, and can present infection hazard in use. Ford's device is also made of a plurality of specialized parts which could be relatively expensive to manufacture. Moreover, since it must be cleaned often, it must be often disassembled for cleaning. Once disassembled, one or more of the parts may be lost or misplaced. Finally, the assembly of Ford's device may not be easy. For example, the pacifier must be held against one end of the tube with one hand, while rolling the cloth around the nipple and the tube with the other hand. Alternatively, if some adhesive were used to hold the pacifier against the tube during assembly, further specialization of the parts may be required.

Another commercial device which operates in a manner similar to the hand made Prior Art of FIGS. 1(A–B) and FIG. 2, is found in the reference to Decker et al. (Decker), U.S. Pat. No. 5,665,336, which issued on Jan. 14, 1997. As best shown in FIG. 6, Decker discloses a cylindrical pillow (14). Near its top, a horizontal slot (27) is provided in one side of the pillow. The slot (27) allows the handle of a standard, commercial pacifier (36) to be inserted. The pillow (14) also has an elongated hollow aperture (20) through its center. A device (40) is inserted from the top into the aperture (20), through the circular opening in the pacifier handle to hold the pacifier in place. The device (40) is then frictionally held within the aperture to hold the whole assembly together. Finally, an outer cloth cover (24) is elastically fitted over the whole unit. The cloth cover can be removed for cleaning.

In operation as a pacifier holder for infants, Decker's device is quite similar to that of Ford's. Thus, the cloth outer cover could become dirty. Decker's device is limited to the use of pacifiers with loop-type handles. However, pacifiers normally used in a hospital environment do not have handles. Decker's device is made of several parts which could make it more expensive to manufacture. Also, the slot in the pillow for inserting the handle of the pacifier may not get dirty in use.

Another example of a wand-type pacifier holder is found in the U.S. Patent to Demeritt et al. (Demeritt), U.S. Pat. No. 5,534,014, which issued on Jul. 9, 1999. Demeritt discloses a pillow pacifier holder formed from a soft foam body (14) with an outer fabric casing (16) which can be washed in a conventional washing machine. The ends of the casing are sewn together over the inner foam member (14). See Col. 3, lines 43–55. A boss (30) is attached to one side of the pillow where the pacifier is attached. The pacifier has an end surface glued to it whereby the annular flange of the pacifier to be attached to the pillow. Demeritt will not accept pacifiers with handles.

Since Demeritt is covered with a cloth fabric, it may become dirty quickly.

The U.S. Patent to Thomas, U.S. Pat. No. 5,593,336, which issued on Jan. 14, 1997, discloses another wand-type pacifier holder. Thomas discloses a device (10) in which the top portion is bent relative to the bottom portion at an angle indicated by the Greek letter Alpha ($\alpha$). See FIG. 3. The basic structure (10) is either a soft, light-weight cushion or a foam device. Structure (10) is covered with a cloth shell (14). The pacifier is attached at the top end of the device by loops (20–22), which are sewn to the cloth covering. The annular flange of the pacifier is inserted beneath the loops (20–22), which then hold the pacifier to the holder.

It does not appear that the cloth shell (14) of Thomas can be removed. The loops (20–22) appear to be an insecure way to hold the pacifier because the annular flange of the pacifier could work out from under the loops. Also, the loops (20–22) may retain the infant's saliva, milk residue or drool. It would further appear that pacifiers without handles may not be used with the Thomas structure. Finally, Thomas is made with a bent shape and multiple part construction.

The final prior art device worth discussing is the U.S. Patent to Kramer, U.S. Pat. No. 4,188,747, which issued on Feb. 19, 1980. Kramer discloses a pacifier holder in the form of a Teddy Bear, but it can take the form of any other similar animal. See, col. 2, lines 21–30. At the end of the Teddy Bear's nose, a vertical slot or receptacle (15) is provided. The slot (15) receives the round loop handle of a conventional pacifier. The outer edges of the slot are lined with VELCRO® or other adhesive so that they stick together to hold the pacifier handle within the slot after it is inserted. See col. 2, lines 38–56. An alternative embodiment is disclosed in FIGS. 5 and 6. In this alternative, the slot (15) is somewhat smaller than the diameter of the loop handle of the pacifier so that when the handle is inserted, the slot stretches around the handle to hold the pacifier in place.

Kramer is covered with a plush cloth fabric so that it may become dirty in use. the slot (15) may be difficult to keep clean. Kramer can only be used with pacifiers that have loop-type handles.

SUMMARY OF THE INVENTION

It is an object of the present invention to provide an apparatus for holding any type of pacifier with a wand-type holder, whereby the non-nutritive perioral and physiological sucking needs of infants and young children are satisfied.

It is a further object of the present invention to provide a wand-type apparatus for holding any type of pacifier, whereby the non-nutritive perioral and physiological sucking needs of very young infants and medically compromised infants are also satisfied.

It is a further object of the present invention wherein the grasping and manipulative motor skills of infants, especially the very young and the medically compromised infants, are enhanced.

It is still further an object of the present invention to provide a flexible wand-type apparatus for holding any type of pacifier, which takes the form of a extended flexible wand with an apparatus which attaches the pacifier near one end of the wand, and wherein the extended portion of the wand can be grasped and manipulated by the infant to enhance the motor skills of the infant.

It is a further object of the present invention wherein the wand-type pacifier holder is formed of a one-piece construction.

It is a further object of the present invention wherein the wand-type pacifier holder is molded in one piece from a non-allergenic, non-toxic, elastomeric material which has a soft texture, but is tough, flexible, long wearing, scuff resistant, heat resistant, easily dyed or colored, easily cleaned, and inexpensive.

It is a further object of the present invention wherein the wand-type pacifier holder includes a tab-flap holder near one end of the wand wherein the tab and the flap fold around the nipple and over the annular flange of a pacifier, and wherein the tab and the flap are locked together when closed to hold the pacifier firmly to the wand.

It is a further object of the present invention wherein the wand-type pacifier holder includes a tab-flap holder near one end of the wand wherein the tab and the flap fold around the nipple and over the annular flange of a pacifier, wherein the tab and the flap are locked together when closed to hold the pacifier firmly to the wand, and wherein the tab and flap are quickly reopened by a caregiver for the removal of a dirty pacifier and the insertion of a fresh, clean pacifier.

It is a further object of the present invention wherein the wand-type pacifier holder is formed of one piece of relatively smooth material so that there are few places for harboring dirt or infection.

It is a further object of the present invention wherein the wand-type pacifier holder is formed of one piece of relatively smooth molded material so that there are few places for harboring dirt or infection, and wherein the device is easily cleaned and sanitized by a number of convenient methods.

It is a further object of the present invention wherein the wand-type pacifier holder may take the form of an adorable animal figure, such as an otter, which an infant may use as a toy.

It is a further object of the present invention wherein the wand-type pacifier holder may take the form of an adorable animal figure, such as an otter, which an infant may use as a toy, and wherein the tab and the flap of the pacifier holder are formed as the forelegs and webbed paws of the otter.

It is a still further object of the present invention wherein the wand-type pacifier holder may take the form of an adorable animal figure such as an otter, which an infant may use as a toy, and wherein the head of the otter is recessed latterly from the pacifier holder so that it does not interfere with the breathing of the infant through his/her nose.

DESCRIPTION OF THE PREFERRED EMBODIMENT

My preferred embodiment is disclosed in FIGS. 3(A–C), 4(A–C), 5(A–B), and 6(A–D) considered collectively. Each element of these Figures which are in common with Prior Art FIGS. 1A, 1B, and 2, will include the same numbering system. Again, the thickness or thinness of the various elements may be exaggerated to facilitate their disclosure.

Figure 3C:
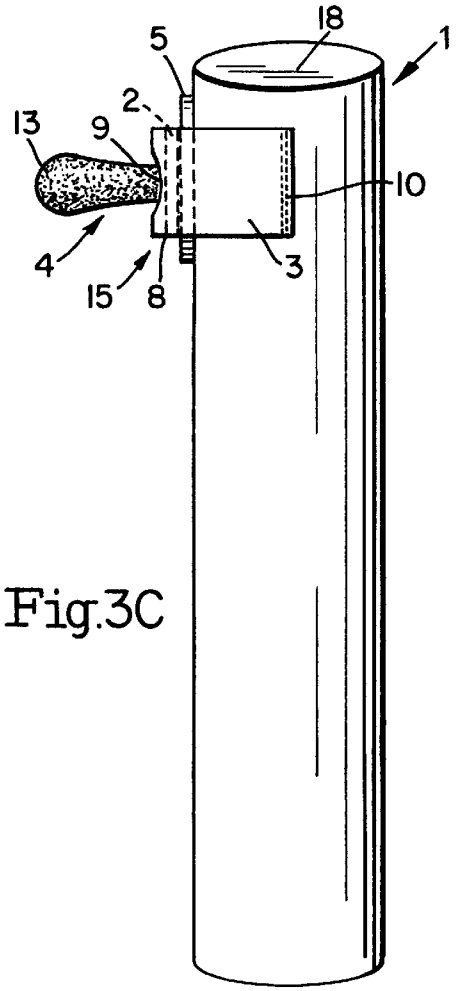
FIG. 3C is the side view of an alternative embodiment of my invention with the pacifier attached.
Figure 3B:
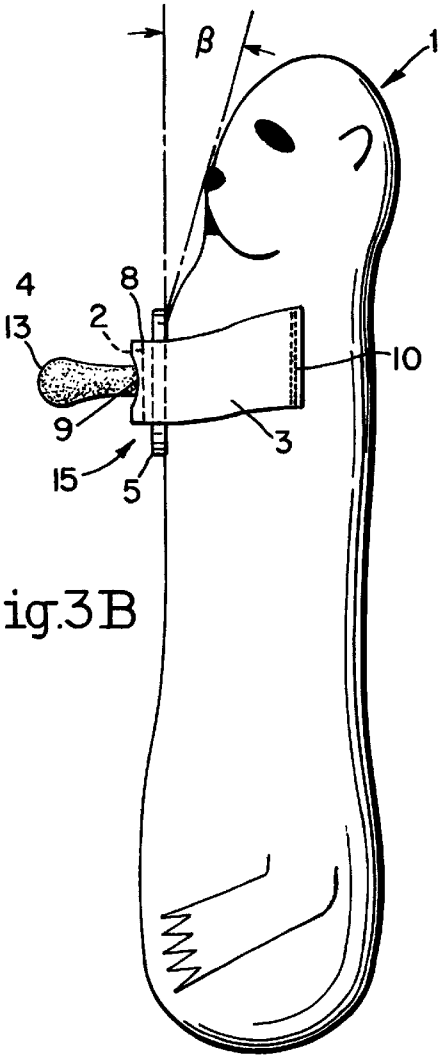
FIG. 3(A–B) are the front and side views of the preferred embodiment of my invention with the pacifier attached.
Figure 3A:
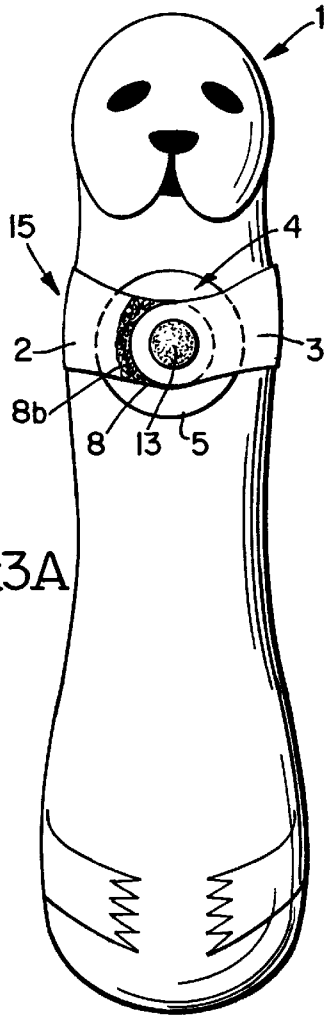

FIG. 3A is a front view of my wand-type pacifier holder (1). FIG. 3B is a side view of the pacifier holder of FIG. 3A. In these Figures, the elongated wand-type pacifier holder (1) takes the form of an adorable animal such as an otter. Alternatively, the wand of my holder can be a straight cylinder, such as shown in FIG. 3C, or it can take any other convenient crosssectional shape, as desired.

The pacifier holder (1) of FIGS. 3A and 3B can have an approximate crossection as small as 1 inch in diameter and 6 inches in length, or as large as 2 or 3 inches in diameter and 18 inches in length, dependent upon the size required for the particular infant. Any convenient elastomeric material can be utilized in molding the holder (1), provided that it is non-toxic and non-allergenic in nature. Further it must be sufficiently soft, resilient and flexible so that it can be flexed by the infant, but it will invariably return to its original shape when the infant's grip is relaxed. The outer surface of the holder (1) must be generally smooth and non-porus so as to minimize the retention of dirt and germs. The outer surface of the holder (1) must also be scuff resistant so that it will wear well in use. The holder (1) must also be sufficiently heat resistant such that it will retain its structural integrity when sanitized in boiling water or even in steam as in a hospital environment. The material used in molding the holder (1) must also be non-soluble to most cleaning solvents such as water, soaps, detergents, alcohol, etc. The holder (1) can be a solid material, a hollow structure, or a foam structure, provided that it otherwise meets each of the above qualifications. While it is desirable that any coloring be molded into the holder (1) at manufacture, coloring may be added externally if necessary. If dyes, pigments, stains or paints are used to color the holder (1) or to paint the eyes, ears, nose, mouth, fur, feet, etc., of the otter, they must also meet the above qualifications. Any materials that are painted on the surface of the holder (1) must also have the ability to bind tightly to the molded surface of the holder so that they will not separate from the molded surface in the normal use of the device over its expected lifetime.

The upper forefeet and webbed paws of the otter of the embodiment of FIGS. 3A and 3B take the form of a tab (2) and a flap (3), which together form the tab-flap holder (15) for the pacifier (4). The thickness of the tab (2) and the flap (3) is exaggerated in all of the Figures, so that their overlapping function is more readily seen. The actual thickness of the tab (2) and the flap (3) depends on the tensile and flexural strength of the material chosen to mold the holder (1). Thus, the actual thickness of these elements is chosen such that the tab (2) and the flap (3) are sufficiently strong and flexible so that the overlapping, locking function is not compromised. At the same time, the tab (2) and the flap (3) must not be so thick that they interfere with the proper function of the pacifier nipple (13).

Preferably, my device is intended to be used with pacifiers that do not have a handle. Thus, the pacifier (4) of FIGS. 3A, 3B and 3C includes the standard annular flange (5) and a nipple (13). The nipple (13) is formed in one piece with the annular flange (5) to make up the one-piece pacifier (4). Such pacifiers are conventional.

Figure 4A:
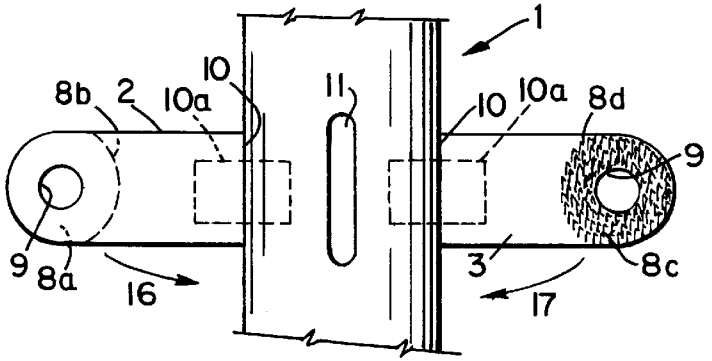
FIG. 4A is a partial view of the front of my preferred embodiment with the tab-flap pacifier holder opened, and the pacifier removed.

Both the tab (2) and the flap (3) of my holder include an enlarged hole (9) which is large enough to loosely fit over and around any size nipple (13) when the tab-flap holder (15) is closed over the pacifier flange (5). The tab (2) is first bent over the pacifier's nipple (13) with the nipple (13) passing through the enlarged hole (9). Then the flap (3) is bent over the tab (2) again with the nipple (13) passing through its enlarged hole. The tab-flap holder (15) is then locked in place around the nipple (13), and over the annular flange (5) of the pacifier, by use of a VELCRO® fastener (8) as best shown in FIG. 3B and FIG. 4A. Other convenient fasteners (not shown) which are known in the art such as, for example, a snap fastener, a hook and eye fastener, a loop and hook fastener, a buckle fastener, a clasp fastener, or even a button fastener, etc., might be alternatively used in place of the VELCRO® fastener (8). Thus, although my preferred embodiment utilizes a VELCRO® fastener, my invention is broadly intended to embrace any other convenient fastener as well.

As disclosed in FIG. 4A, the tab (2) and the flap (3) of the tab-flap holder (15) are shown opened, i.e., before the pacifier is to be held by the device. In FIG. 4A, the opened tab (2) has a VELCRO® material (8*a*) molded into and on the surface facing inwardly in the drawing. The VELCRO® material (8*a*) is molded into and on this inwardly facing surface around the enlarged hole (9) at least to the extent indicated by the dotted line (8*b*). Other shapes for the VELCRO® material (8*a*) are contemplated within the broad teachings of this invention as long as there is sufficient overlap with the mating surface of the flap to assure the proper fastening of the tab-flap holder. Similarly, as also disclosed in FIG. 4A, the opposite VELCRO® fastening material (8*c*) is molded into and on the opened flap (3) surface which facing outwardly in the drawing around its enlarged hole (9) at least to the extent indicated by line (8*d*). Again, other shapes for this fastening material (8*c*) are also contemplated within the broad teachings of my invention. Alternatively, the VELCRO® materials can be adhered to the mating surfaces of the tab (2) and the flap (3) by any other convenient adhesives such as glue, etc.

The detailed operation of my invention is best shown in FIGS. 4A and 3A, as follows. First, the flat side of annular flange (5) of a pacifier (4) without a handle, is placed against the front surface of the holder (1). Thereafter, the tab (2) is bent over the nipple (13), and against the outer surface of the annular flange (5) as indicated by the arrow (16) in FIG. 4A. Since tab (2) includes an enlarged hole (9), the pacifier nipple (13) easily passes through that enlarged hole (9) as the tab (2) is bent over the pacifier so that the tab (2) can snugly fit over the annular flange (5). With the tab (2) fitting snugly around the nipple (13) and over the annular flange (5), its VELCRO® surface (8*a*) now faces outwardly. Thereafter, the flap (3) is similarly bent over the pacifier as indicated by the arrow (17) in FIG. 4A. Again, the nipple (13) of the pacifier easily passes through the enlarged hole (9) of the flap (3) as it is bent over the pacifier (4). This time, however, the VELCRO® surface (8*c*) of the flap (3) locks with the mating surface (8*a*) of the tab (2), and securely holds the pacifier (4) to the wand holder (1). This is best shown in my preferred embodiment of FIGS. 3A and 3B.

Of course, the tab-flap holder (15) can be easily opened to remove or change a dirty pacifier (4), simply by pulling the mating surfaces of the VELCRO® fastener apart to free the pacifier. While not necessarily required, it may be desirable to aid in the freeing of the pacifier from the holder (1) when the fastener is opened by including a moderate opening bias within the tab (2) and the flap (3) which causes them to move to their normally open positions (shown in FIG. 4A) when the fastener is released. This bias could normally be an inherent characteristic of the resilient, elastomeric material from which the device is molded. Finally, the tab (2) and the flap (3) may take other forms or shapes dependent upon the type of fastener which is chosen to lock the unit together. Examples of different types of fasteners are listed above.

In my preferred embodiment, the mating VELCRO® surfaces are molded into and on the tab (2) and the flap (3) surfaces at manufacture so that a one-piece construction for my device is maintained. In other words, in my tab-flap holder (15), the mating VELCRO® surfaces are molded into the tab (2) and the flap (3) while my device is being manufactured in the molding machine. Thus, in my preferred embodiment, it would be very difficult for the VELCRO® surfaces (8*a* and 8*c*) to be ever separated from the tab (2) or the flap (3) in use. In contrast, if the VELCRO® materials are glued on, or adhered to the tab (2) and the flap (3) by other techniques, the VELCRO® material may ultimately work loose in use, no matter how good the glue or other adhering technique might be. Nevertheless, my invention is intended to broadly embrace any adhering technique for attaching the VELCRO® fastening materials to the tab (2) and the flap (3). A continuous lip can be alternatively provided around the edges of the VELCRO® surfaces so that the edges of those surfaces are sealed when fastened to minimize the seepage of saliva, etc., into the VELCRO® surfaces when the tab-flap fastener is closed. Such a continuous lip would further minimize the threat of infection when my device is in use.

Figure 6A:
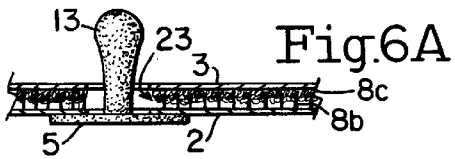
FIG. 6A is an enlarged side view of the pacifier holders of FIGS. 3(A–C) and 4(A–C), wherein no lips are provided to minimize the free transmission of saliva, dirt and infection into and through the hook and loop fastener elements when the unit is in use.

FIG. 6A discloses an enlarged side view of the pacifier holders of FIGS. 3(A–C) and 4(A–C). All of the common elements of these FIGS. remain the same and will not be further discussed. Without sealing lips around the hook and loop VELCRO® elements 8*b* and 8*c* of the closed fastener, it is clear that the infant's salvia, dirt or possibly infectious material, indicated by the arrow 23, are allowed to freely enter into the nooks and crannies of the fastener elements 8*b*–8*c* by means of the enlarged hole 9. While this salvia, dirt and possibly infectious material is easily cleaned when the pacifier holder is cleaned, the pacifier holder might be used for an extended time period between cleaning. Therefore, salvia, dirt and infection might accumulate without frequent cleaning.

FIGS. 6(B–D) show three simple examples for providing lips around the hook and loop fastener elements to minimize the entry of salvia, dirt and infection into the fastener elements during use.

Figure 6B:
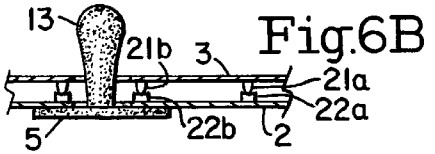
FIG. 6B is an enlarged side view of the pacifier holders of FIGS. 3(A–C) and 4(A–C), with mating lips around the hook and loop fastener elements.

In FIG. 6B, the upper fastener flap element 3 includes lips 21*a* and 21*b* which surround the fastener elements 8*c*. These lips are continuous around the fastener elements, and have a downwardly directed generally pointed cross section. The mating fastener tab element 2 includes upwardly extending lips 22*a* and 22*b* which have a cross sectional depression which receives and seals the generally pointed upper lips 21*a* and 21*b* when the fastener is closed. Consequently, in use, salvia, dirt and infection are generally blocked from entering into the nooks and crannies of the closed fastener. Since the lips are molded as part of the one-piece construction, they are made of the same flexible and resilient material, so that any misalignments, if they occur, are compensated for in use. Thus, the lips are very effective in sealing the fastener elements from salvia, dirt and infection.

Figure 6C:
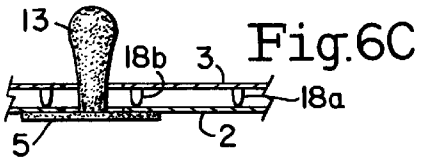
FIG. 6C is an enlarged side view of the pacifier holders of FIGS. 3(A–C) and 4(A–C), with only one lip provided around the hook and loop fastener elements.

In FIG. 6C, only upper lips 18*a* and 18*b* are employed. In this embodiment, lips 18*a* and 18*b* are of sufficient length, flexibility and resiliency so that an effective seal is achieved betweem them and the flat upper surface of tab element 2 when the fastener is closed.

Figure 6D:
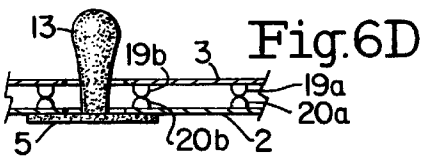
FIG. 6D is an enlarged side view of the pacifier holders of FIGS. 3(A–C) and 4(A–C), with similar upper and lower lips provided around the hook and loop fastener elements.

In FIG. 6D, upper and lower lips 19*a*, 19*b* and 20*a*, 20*b*, are provided which have the same cross sectional profile. Again, however, they are sufficiently flexible and resilient so that when the fastener elements are closed, the lips resiliently abut one another and provide an effective seal against saliva, dirt and infection.

FIG. 4A discloses another alternative feature of my invention. Every time a dirty pacifier (4) is replaced by a new or clean pacifier in my holder, the tab (2) and the flap (3) must be flexed open and shut. This constant flexing causes a great stress at the joints (10) where the tab (2) and the flap (3) are attached to the body of my holder (1). In my preferred embodiment, the material chosen for molding the body (1), the tab (2), and the flap (3) of my device is such that this constant flexing never causes any problem during the reasonable lifetime of the device. However, depending upon the elastic limit of the flexible material chosen from which my device is molded, it is conceivable that this constant flexing at the bending joints (10) may ultimately cause the tab (2) or the flap (3) to crack or even break loose at these bending joints (10). Accordingly, reenforcing devices or hinges (10*a*) may be molded into the joints (10) so that such cracking or breaking of the flexible material will not allow either the tab (2) or the flap (3) to break loose during the reasonable lifetime of the device.

Such reenforcement or hinges (10*a*) are preferably molded within the tab (2), the flap (3), and the body (1) so that my overall unit retains its one-piece construction. However, the bending reenforcement or hinges (10*a*) may be alternatively glued or adhered by other techniques along the surfaces of the tab (2), the flap (3), and the body (1) of my device. Again, the molding of these devices into the holder is preferred because any glue or adhering technique is more likely to work loose than the molding of the devices (10*a*) within the holder. Nevertheless, my invention is intended to broadly embrace any technique for applying the reenforcement or hinges (10*a*). If convenient, such reenforcement or hinges (10*a*) may also provide the bias discussed above tending to open the tab (2) and the flap (3) after the fastener has been opened.

Figure 4B:
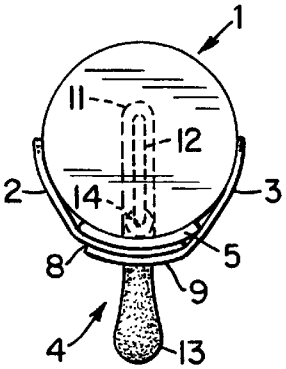
FIG. 4B is a view of FIG. 4A from the top, facing downwardly.

FIG. 4A in combination with FIG. 4B, also discloses another variation of my invention. As shown in FIG. 4A, an optional horizontal slot (11) can be molded into the body (1) of my pacifier holder. FIG. 4B is a view of FIG. 4A as seen from the top with a pacifier (4) installed in the holder (1). In FIG. 4B, the slot (11), shown in phantom line, discloses the extent of the slot (11) into the body (1). The purpose of the slot (11) is to accommodate pacifiers with handles. As I discussed above, pacifiers come in many sizes and shapes. Many times pacifiers are equipped with handles so that older infants can grasp the pacifier. Thus, the pacifier (4) shown in FIG. 4B discloses a handle (12) which is conventionally attached to the back of the annular flange (5) by a hinged joint (14). As shown in FIG. 4B, the pacifier handle (12) is allowed to be inserted into the slot (11). Then, the tab (2) and flap (3) can be fastened together around the nipple (13) and against the annular flange (5), to hold the pacifier in place without any interference with the pacifier handle in the same manner as described above.

However, as discussed above with respect to the prior art reference to Decker and the prior art reference to Kramer, the use of a slot (11) to accommodate pacifiers with handles within the body of a pacifier holder (1) can harbor dirt and infectious germs. Therefore, the preferred manner of using my invention is to use a pacifier that does not have a handle so that the slot (11) is unnecessary. This is the case of the pacifier (4) as shown installed in FIGS. 3A, 3B and 3C. However, if the use of such a slot (11) is deemed necessary, its inner surface is preferably rounded and smooth so that it is easily cleaned and drained, whereby the possibility of harboring dirt and infection is minimized.

Figure 4C:
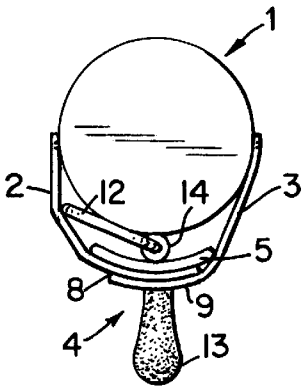
FIG. 4C is an alternative view of FIG. 4A from the top, facing downwardly.

It is also possible to hold a pacifier with a handle with my holder (1) without providing a slot (11) for the handle. This embodiment is shown in FIG. 4C. Thus, FIG. 4C is a top view of FIG. 4A without the optional slot (11). As shown in FIG. 4*c*, a pacifier (4) with a handle (12) can be accommodated by my holder even though no slot (11) is provided. Since pacifiers with handles usually have the handle attached to the annular flange (5) with a hinge (14) so that the handle (12) can be pivoted to one side or the other, my device will accommodate such a handle as indicated by FIG. 4C. Here, the handle (12) is simply pivoted to the left with respect to the rest of the pacifier about the hinge (14). Therefore, my preferred embodiment without a slot (11), can also accommodate a pacifier handle as shown in FIG. 4C. In this embodiment, it may be necessary for the lengths of the tab (2) and the flap (3), and the diameter of their enlarged holes (9), to be somewhat larger to accommodate the bulk of the handle. However, even though the lengths of the tab (2) and the flap (3) may be somewhat longer than that required for a pacifier without a handle, and even though the diameter of the enlarged holes (9) may be somewhat larger than that required for a pacifier without a handle, this embodiment will easily accommodate a pacifier either with or without a handle. This is because, when used with a pacifier without a handle, any slack in the tab-flap holder (15) is easily taken up as the flap (3) is tightly fastened over the tab (2).

There is still another feature of my preferred embodiment which is best shown in FIGS. 3B and 3C. Since the pacifier (4) is locked to the holder (1) by the tab-flap holder (15) at the chest level of the otter, the upper chest area and the head of the otter could interfere with the infant's nose, and consequently the infant's breathing while sucking on the pacifier. Therefore, in my preferred embodiment, the upper chest area and the otter's head are offset latterly to the right as shown in FIG. 3B by an angle shown by the Greek letter Beta (β).

In the embodiment of FIG. 3C, where the holder (1) takes the form of a straight cylinder, there is no interference problem with the infant's nose because the tab-flap holder (15) is located close to the upper surface (18) of the holder (1).

Figure 2:
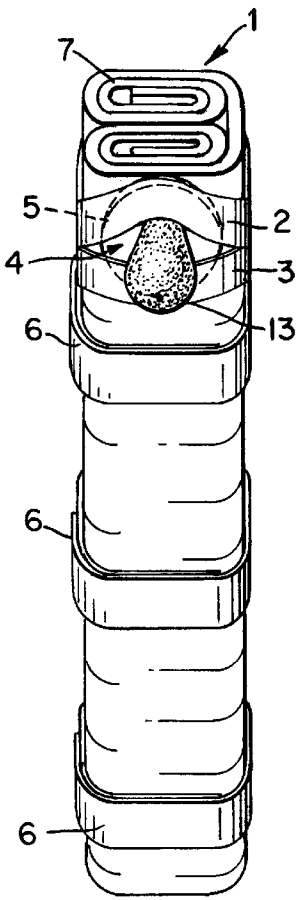
Fig.2 (PRIOR ART)
FIG. 2 is an orthogonal front view of the Prior Art, jerry built pacifier holder of FIGS. 1(A–B).
Figure 1B:
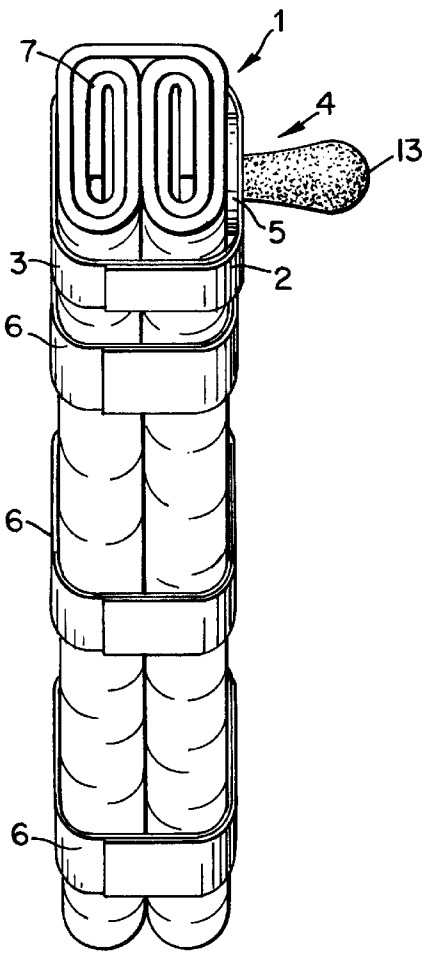
Fig.1B (PRIOR ART)
FIG. 1B is an orthogonal side view of the Prior Art, jerry built pacifier holder.
Figure 1A:
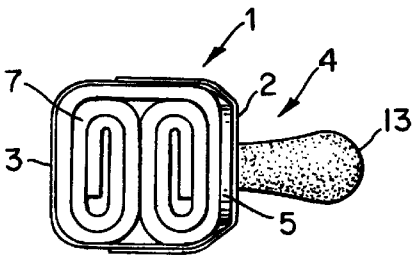
Fig.1A (PRIOR ART)
FIG. 1A is the top view of the Prior Art, jerry built pacifier holder.

The embodiments of FIGS. 3B and 3C should be compared with the jerry built or hand made prior art device of FIGS. 1A, 1B and 2. In the prior art, when the pacifier (4) is taped to the upper edge of the holder (1), the tape segments (2) and (3) may be easily pulled loose causing the choking hazard for the infant described above. Moreover, in the prior art, if the pacifier (4) is taped at a lower point along the holder (1) to avoid pulling loose, the infant's nose would clearly interfere with the upper part of the holder (1) causing a breathing problem when the infant is sucking on the pacifier. Both of these problems are completely obviated by my preferred embodiments as shown in FIGS. 3B and 3C.

Figure 5A:
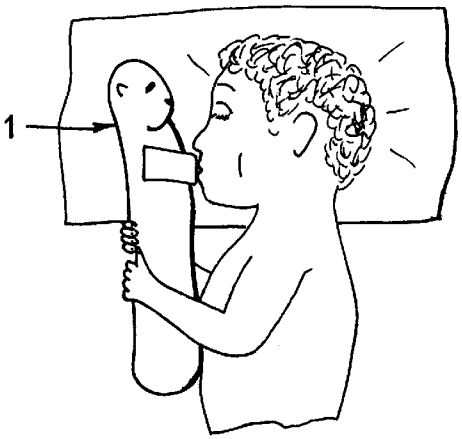
FIG. 5A is a view of the preferred embodiment of my invention in which an infant is grasping the wand and sucking the pacifier.
Figure 5B:
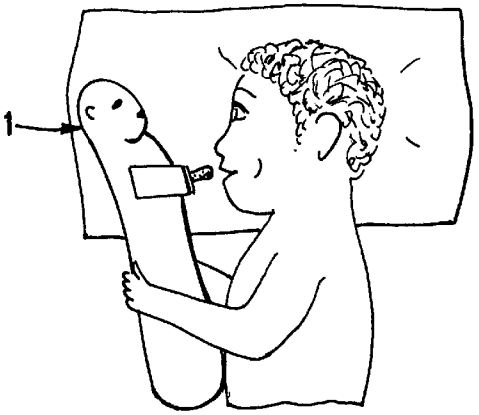
FIG. 5B is a view of the preferred embodiment of my invention in which an infant has let the pacifier fall from his/her mouth, but is still happily grasping and fondling the pacifier holder as an adorable toy.

Turning now to FIGS. 5A and 5B of my preferred embodiment, the use of my invention is depicted. FIG. 5A discloses an infant sucking on a pacifier holder (1) in the shape of an otter such as that disclosed in FIGS. 3A and 3B. The infant is shown lying on his/her side with the pacifier inserted in his/her mouth. The elongated wand (the otters lower body) is in such a position that it can be easily grasped by the infant as shown in this Figure. By grasping the otter's body, the infant soon learns that he/she can manipulate the pacifier within the mouth, thus reenforcing his/her grasping skills.

The infant ultimately acquires the ability to adjust the pacifier within his/her mouth by adjusting his/her grasp on the otter's body. This action in turn enhances the perioral action of the pacifier, and the grasping skills of the infant.

Eventually, the infant learns that he/she can remove the pacifier from its mouth, and to reinsert it as desired. These actions greatly benefit the infant's interactive oral-motor capabilities, especially for young infants, and for those infants who are medically compromised.

Finally, as the infant further advances beyond the point where a pacifier is no longer needed, caregivers can remove the pacifier and leave the tab-flap holder open as in FIG. 4A so that the tab and the flap form the floppy forelegs of the adorable toy animal. Thus, my invention is further capable of being used by the maturing infant simply as a play toy. The grasping skills of infants may even advance to the point that they can replace their own pacifiers using the tab-flap holder themselves, such as at nap times.

Without further analysis, the foregoing so fully reveals the gist of the present invention that others can, by applying current knowledge, readily adapt it for various applications. Therefore, such adaptions should, and are intended, to be included within the broad limitations of the appended claims.

I claim:

1. An apparatus for satisfying the non-nutritive, oral-motor sucking needs of infants comprising:

(a) a one-piece elongated body of flexible, resilient, non-toxic, non-allergenic, elastomeric material;

(b) the outer surface of said one-piece elongated body being soft, smooth, and non-porous which resists the collection of moisture, infection and dirt in use;

(c) said one-piece elongated body further comprising a length which takes the form of a wand;

(d) said one-piece elongated body having a two-piece tab-flap pacifier holder attached thereto near one end of said one-piece elongated body;

(e) said two-piece tab-flap pacifier holder comprising an elongated flat tab attached along one of its ends to one side of said one-piece elongated body, and an elongated flat flap attached along one of its ends to the opposite side of said one-piece elongated body;

(f) said two-piece tab-flap pacifier holder is comprised of the same material as said one-piece elongated body and is an integral part of said one-piece elongated body;

(g) said elongated flat tab and said elongated flat flap also including an enlarged hole near each respective opposite end, having a diameter of such size that the nipple of a conventional pacifier will pass freely therethrough;

(h) said opposite end of said flat flap overlapping said opposite end of said elongated flat tab, fastening means associated with each of said opposite ends, whereby a nipple of a conventional pacifier when passed through said enlarged holes can be firmly secured against the upper end of said one-piece elongated body;

(i) whereby said apparatus does not easily become dirty or harbor infection in use, and whereby said apparatus is easily cleaned if it does become dirty or infected;

(j) whereby said apparatus has minimal surfaces where infectious germs and viruses can be harbored;

(k) whereby said apparatus reinforces an infant's grasping skills, provides consistent perioral stimulation, and enhances an infant's ability to control and keep a pacifier in an infant's mouth for independent sucking.

2. The apparatus of claim 1, wherein said elongated body comprises an approximately circular crossection.

3. The apparatus of claim 1, wherein said flexible, resilient, non-toxic, non-allergenic, elastomeric material is further comprised of supple, scuff resistant, and heat resistant material.

4. The apparatus of claim 1, wherein said elongated body and said two-piece tab-flap pacifier holder are comprised of molded material.

5. The apparatus of claim 4, wherein said molded material of said elongated body comprises a hollow elastomeric material.

6. The apparatus of claim 4, wherein said molded material of said elongated body comprises a solid elastomeric material.

7. The apparatus of claim 4, wherein said molded material of said elongated body comprises a foamed elastomeric material.

8. The apparatus of claim 1, wherein said fastening means of said two-piece tab-flap pacifier holder comprises a first portion of densely woven hooks and a second portion of densely woven loops which, when pressed together, firmly interlock to close said two-piece tab-flap pacifier holder.

9. The apparatus of claim 1, wherein a vertical slot is provided in said elongated body, behind said two-piece tab-flap pacifier holder to accommodate an infant's pacifier having a handle.

10. The apparatus of claim 1, wherein a pacifier having a handle may be accommodated behind said two-piece tab-flap pacifier holder by folding said handle behind either said elongated flat tab or said elongated flat flap.

11. The apparatus of claim 1, wherein the joints where said elongated flat tab and said elongated flat flap are attached to said elongated body may include reinforcing hinges to prevent the cracking or breaking of said elongated flat tab or said elongated flat flap from said elongated body during the normal lifetime of said apparatus, and wherein said reinforcing hinges may include a spring bias tending to open said elongated flat tab and said elongated flat flap when said two-piece fastener is opened.

12. The apparatus of claim 1, wherein said two-piece tab-flap pacifier holder includes continuous lips on each piece whereby said fastening means is effectively sealed from moisture when said two-piece tab-flap pacifier holder is closed.

13. The apparatus of claim 1, wherein said elongated body comprises the shape of and adorable toy animal, wherein said two-piece tab-flap pacifier holder comprises the forelegs and paws of said adorable toy animal, and wherein the head of said adorable toy animal is laterally offset from the plane of said two-piece tab-flap pacifier holder whereby said head will not interfere with the breathing of an infant.

14. The apparatus of claim 13, wherein the shape of said adorable toy animal is an otter.

* * * * *